US007608314B2

(12) United States Patent
Plant

(10) Patent No.: US 7,608,314 B2
(45) Date of Patent: Oct. 27, 2009

(54) FLEXIBLE ENERGY ABSORBING MATERIAL AND METHODS OF MANUFACTURE THEREOF

(76) Inventor: Daniel James Plant, Treguff Farm, St. Mary Church, Vale of Glamorgan, Wales, Cowbridge (GB) CF71 7LT ( * ) Notice: Subject to any disclaimer, the term of this patent is extended or adjusted under 35 U.S.C. 154(b) by 0 days.

(21) Appl. No.: 10/797,756

(22) Filed: Mar. 10, 2004

(65) Prior Publication Data

US 2004/0171321 A1 Sep. 2, 2004

Related U.S. Application Data

(63) Continuation of application No. PCT/GB02/04209, filed on Sep. 13, 2002.

(30) Foreign Application Priority Data

| | | |
|---|---|---|
| Sep. 13, 2001 | (GB) | 0122082.1 |
| Sep. 13, 2001 | (GB) | 0122084.7 |
| Oct. 4, 2001 | (GB) | 0123844.3 |

(51) Int. Cl.

| | |
|---|---|
| ***B32B 7/00*** | (2006.01) |
| ***B32B 7/04*** | (2006.01) |
| ***B32B 3/12*** | (2006.01) |
| ***B32B 3/22*** | (2006.01) |
| ***B32B 33/00*** | (2006.01) |

(52) U.S. Cl. ..... 428/86; 428/96; 428/119; 428/116; 428/117; 442/2; 442/43; 442/104

(58) Field of Classification Search ..... 428/86, 428/909, 87, 96, 119, 116, 117, 118; 442/1, 442/2, 43, 61, 104, 134, 135

See application file for complete search history.

(56) References Cited

U.S. PATENT DOCUMENTS

| | | | | |
|---|---|---|---|---|
| 2,744,042 | A | | 2/1956 | Pace |
| 3,513,842 | A | | 5/1970 | Keenan et al. |
| 3,649,426 | A | | 3/1972 | Gates, Jr. |
| 3,663,973 | A | | 5/1972 | Spence |
| 3,676,288 | A | | 7/1972 | Hoyle |
| 3,864,181 | A | | 2/1975 | Wolinski et al. |
| 4,864,737 | A | | 9/1989 | Marrello |
| 4,905,320 | A | | 3/1990 | Squyers, Jr. |
| 5,090,053 | A | * | 2/1992 | Hayes ..... 2/2.5 |
| 5,599,290 | A | | 2/1997 | Hayes et al. |
| 5,776,839 | A | | 7/1998 | Dischler et al. |

(Continued)

FOREIGN PATENT DOCUMENTS

| | | | |
|---|---|---|---|
| CN | 101140151 | A * | 3/2008 |

(Continued)

*Primary Examiner*—Cheryl Juska
(74) *Attorney, Agent, or Firm*—Carter, DeLuca, Farrell & Schmidt, LLP

(57) ABSTRACT

A flexible energy absorbing sheet material in which a dilatant material (6) is impregnated into or supported by a resilient carrier (1). The dilatant material remains soft until it is subjected to an impact when its characteristics change rendering it temporarily rigid, the material returning to its normal flexible state after the impact. The carrier can be a spacer fabric, a foam layer or modules or threads of dilatant material contained between a pair of spaced layers. Methods of manufacturing the energy absorbing sheet are also disclosed.

8 Claims, 10 Drawing Sheets

U.S. PATENT DOCUMENTS

| | | | | |
|---|---|---|---|---|
| 5,854,143 | A | 12/1998 | Schuster et al. | |
| 6,670,018 | B2 * | 12/2003 | Fujita et al. | 428/86 |
| 6,701,529 | B1 * | 3/2004 | Rhoades et al. | 2/2.5 |
| 6,766,817 | B2 | 7/2004 | Da Silva | |
| 6,913,802 | B1 * | 7/2005 | Plant | 428/35.2 |
| 7,226,878 | B2 * | 6/2007 | Wagner et al. | 442/59 |
| 7,498,276 | B2 * | 3/2009 | Wagner et al. | 442/59 |
| 2004/0171321 | A1 * | 9/2004 | Plant | 442/64 |
| 2005/0037189 | A1 * | 2/2005 | Palmer et al. | 428/304.4 |
| 2005/0266748 | A1 * | 12/2005 | Wagner et al. | 442/59 |
| 2006/0234572 | A1 * | 10/2006 | Wagner et al. | 442/59 |
| 2006/0234577 | A1 * | 10/2006 | Wagner et al. | 442/135 |
| 2006/0260210 | A1 * | 11/2006 | Tanielian et al. | 52/2.11 |
| 2007/0107778 | A1 * | 5/2007 | Bettin et al. | 137/13 |
| 2008/0296435 | A1 * | 12/2008 | Cohen | 244/158.3 |
| 2009/0004413 | A1 * | 1/2009 | Wagner et al. | 428/34.1 |

FOREIGN PATENT DOCUMENTS

| | | | |
|---|---|---|---|
| EP | 0941751 | A2 | 9/1999 |
| GB | 2349798 | A | 11/2000 |
| JP | 06-220242 | | 9/1994 |
| WO | WO 00/16652 | | 3/2000 |
| WO | WO 00/46303 | | 8/2000 |
| WO | WO 00/69293 | | 11/2000 |
| WO | WO 01/43677 | A1 | 6/2001 |
| WO | WO 01/45914 | A2 | 6/2001 |
| WO | WO 2007102020 | A1 * | 9/2007 |
| WO | WO 2008115636 | A2 * | 9/2008 |

* cited by examiner

FLEXIBLE ENERGY ABSORBING MATERIAL AND METHODS OF MANUFACTURE THEREOF

CROSS-REFERENCE TO RELATED APPLICATIONS

The present application is a Continuation Application of International Application No. PCT/GB02/04209, filed on Sep. 13, 2002, which in turn claims the benefit of and priority to GB Application Nos. 0122082.1 and 0122084.7, filed on Sep. 13, 2001, GB Application No. 0123844.3, filed on Oct. 4, 2001.

BACKGROUND

1. Technical Field

This invention relates to a flexible energy absorbing material, preferably in sheet form, and to methods of manufacture thereof.

2. Background of Related Art

Known impact protection solutions currently available tend to fall into two types, namely a rigid exterior shell which can be uncomfortable to wear (e.g. roller blade or skateboard knee or elbow pads) or foam or foam laminate pads (e.g. inserts for ski clothing) which provide poor levels of protection.

There is therefore a need to provide an energy absorbing material which is both light and flexible and therefore comfortable to wear while still being able to dissipate and absorb shock impacts applied to it thereby providing effective protection for the wearer.

In my earlier published UK patent application No. 2349798, I describe and claim a protective member which uses an energy absorbing material which remains soft and flexible until it is subjected to an impact when it becomes rigid, said material being encapsulated in a flexible sealed envelope formed with one or more convolutions thereon each having an apex directed towards the direction of impact whereby an impact force applied to the or each apex is absorbed as the material becomes rigid.

The preferred energy absorbing material is a dilatant material which acts very much like a fluid when soft. It therefore needs to be contained within a sealed flexible envelope to enable it to be used as a protective member. If, for instance, the envelope is ruptured accidentally, the dilatant material would escape through the punctured hole in the envelope. Because of the need for the sealed envelope, the protective members can be expensive to manufacture and they have to be user specific so a dedicated moulding process is needed to manufacture them.

SUMMARY

It is therefore an object of the invention to provide a flexible energy absorbing material and method of manufacture thereof which obviates the need to contain the dilatant material in a flexible sealed envelope and which can be readily moulded or otherwise shaped into a product which can be used in a variety of energy absorbing uses.

It is a further object of the invention to provide methods of manufacturing the aforementioned flexible protective material.

According to one aspect of the invention, there is provided flexible energy absorbing material comprising a resilient carrier with voids or cavities therein, said carrier being coated or impregnated with a material, which is soft and flexible until it is subjected to an impact when its characteristics change to render it temporarily rigid, the material returning to its normal flexible state after the impact.

The preferred material is a dilatant compound. The carrier can be a spacer material.

In one embodiment the resilient carrier comprises a resilient core sandwiched between a pair of covering layers. The resilient core can comprise a layer of yarn, the covering layers having a plurality of apertures therein which can be hexagonal, diamond shaped or any other suitable shape.

The resilient carrier can be knitted or woven into a resilient pile. Preferably the yarn is between 0.05 and 1 mm in diameter. The yarn can be a monofilament or a multifibre thread.

The outer surface of each covering layer can be formed with a plurality of compressible bubbles thereon.

Elongate hollow channels can be formed in the compressible core which may be tubular and parallel to each other.

Holes can be formed through the sheet material to reduce its mass.

The resilient carrier can be made of a foam material which is preferably an open cell foam.

The resilient carrier can however be a fleece material or a Scotch-Bright (3M Trade Mark) material.

According to another aspect of the invention there is provided a flexible energy absorbing material comprising a resilient core of discrete modules made of dilatant compound sandwiched between a pair of covering layers. The modules can be randomly arranged in the compressible core or axially aligned rows across the width of the sheet.

Alternatively, the modules can comprise of parallel elongate hollow tubular members in said covering layers.

Each module can have a covering layer thereon which may be made of another material or it can be a hard outer skin of said dilatant material.

The modules can be spherical and they are preferably hollow. The hollow centre can be filled with a lightweight resilient filler material such as spheres of an ion exchange resin sold under the tradename DUOLITE™ (available from Rohm and Haas Company, Philadelphia, Pa.).

According to another aspect of the invention an energy absorbing material comprising a thread formed from a dilatant compound which is woven or knitted into a compressible layer.

Preferably, the compressible layer is contained between a pair of spaced sheets of supporting material and the threads have a covering layer thereon which may be a harder skin of the dilatant compound or a separate layer.

The thread can be hollow.

One of the covering layers can be a woven textile material containing a polyaromatic amide thread. The other covering layer can be a textile layer. The two covering layers can however be made of the same material.

Preferably, the dilatant compound is a dimethyl-siloxane-hydro-terminated polymer.

The dilatant compound can include a lightweight filler such as DUOLITE™ spheres therein.

The preferred dilatant compound is dimethyl-siloxane-hydro-terminated polymer, sold under the tradename, DOW CORNING™ 3179, available from Dow Corning™ Corporation, Midland, Mich.

According to a still further aspect of the invention, there is provided a method of manufacturing an energy absorbing material comprising a resilient carrier with a dilatent material therein comprising the steps of heating the dilatant material to convert it from its normal semi-solid state into a flowable form and working the flowable material into the resilient carrier to impregnate said carrier with the dilatent material.

Preferably, the dilatant material is heated to 150° C.

The dilatant material can be fed between a pair of spaced sheets of material with voids or cavities therein and then between a pair of heated rollers which press the dilatant material into the voids in the spaced sheets of material, the energy absorbing sheet with the dilatant material therein emerging from the rollers.

Alternatively, the carrier is a foam material and the flowable dilatant material is pressed into the foam into under pressure at approximately 150° C.

The invention further provides a method of manufacturing an energy absorbing material comprising a resilient carrier impregnated with a dilatant material comprising the steps of reducing the viscosity of the dilatant material from its normal semi-solid state into a flowable foam using a solvent, pouring the thinned dilatant material into the carrier, and finally removing the solvent from the formed energy absorbing material.

The solvent can be evaporated from the sheet material by applying heat thereto.

Conveniently, the solvent is propanol, isopropyl alcohol, methanol, dichloromomethane, trichloromethane or a mixture thereof.

The material of the invention can further include a lubricant and/or a filler.

In one embodiment, the dilatant is a polyborosiloxane such as a borosiloxane copolymer, wherein the borosiloxane copolymer comprises a plurality of siloxane groups, each of the formula $(OSiR_1R_2)$, wherein $R_1$ and $R_2$ can be the same or different and each, independently, is a substituted or unsubstituted alkyl or aryl group. Conveniently, the alkyl group contains 1 to 6 carbon atoms and one or both of $R_1$ and $R_2$ is a methyl, phenyl or 1,1,1, trifluoropropyl group.

Each of the siloxane groups can be of the formula $(OSiMePh)$, $(OSiMe_2)$, $(OSiPh_2)$ or $(OSi(CH_2CH_2CF_3)Me)$.

The borosiloxane copolymer can include more than one type of siloxane group, each with a different combination of substituents $R_1$ and $R_2$.

Conveniently, the siloxane groups are in blocks or units of the formula $(OSiR_1R_2)_n$, wherein n is an integer greater than or equal to 4 and less than or equal to 50. Suitably, the borosiloxane copolymer includes polysiloxane units of the formula: $(OSiMePh)_n$, $(OSiMe_2)_n$, $(OSiPh_2)_n$, $(OSi(CH_2CH_2CF_3)Me)_n$, $[(OSiMe_2)_a(OSiMePh)_b]_n$ or $[(OSiMe_2)_a(OSiPh_2)_b]_n$, wherein n is as defined, a and b are integers greater than or equal to 1 and less than or equal to 49, and a+b=n.

The lubricant can be a silicone oil, fatty acid, fatty acid salt or hydrocarbon grease. The filler can be a solid particulate or fibrous filler such as silica, silica and/or polymeric microspheres, a phenolic resin, a thermoplastic material, a ceramic material, a metal or a pulp material.

BRIEF DESCRIPTION OF THE DRAWINGS

The invention will now be described, by way of example only, with reference to the accompanying drawings, in which.

DETAILED DESCRIPTION OF PREFERRED EMBODIMENTS

Figure 1:
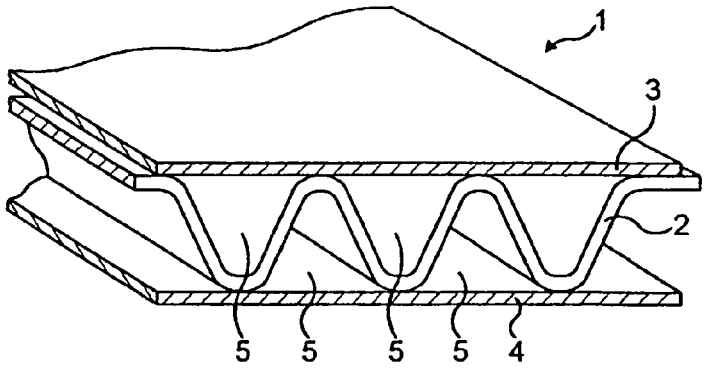
FIG. 1 is a perspective view showing one type of carrier material which forms part of the energy absorbing sheet of the invention.

Referring now to FIG. 1, there is shown one form of carrier 1 which can be used to form the flexible energy absorbing sheet material of the present invention. The carrier 1 comprises a ribbed material 2 which is sandwiched between and joined to a top sheet 3 and a bottom sheet 4. These sheets may be made out of any suitable material but preferably they are made from a textile material which may have surface treatments or coatings thereon. The coatings would be on the outer surface of each sheet 3 or 4 and not on the ribbed material 2 and could be a waterproof coating. Spaces or voids 5 are formed between each of the longitudinally extending ribs for reasons which will be explained hereafter.

Figure 2:
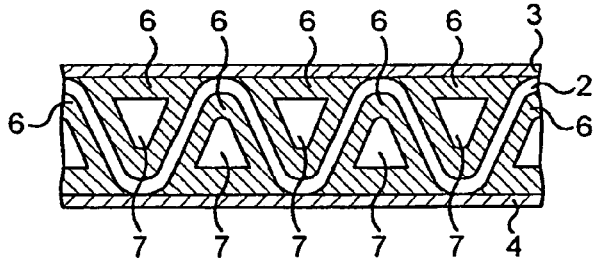
FIG. 2 is a cross section through the carrier material shown in FIG. 1 but after the addition thereto of a dilatent compound to form an energy absorbing sheet of the invention.

Referring now to FIG. 2, it can be seen that the spaces 5 have been filled with an energy absorbing dilatent compound material 6 leaving a hollow core 7 therein. These hollow cores can be left empty or they can be filled with a low density material such as spheres of an ion exchange resin sold under the tradename DUOLITE™ (available from Rohm and Haas Company, Philadelphia, Pa.) or any other suitable low weight filler which would help to add resilience to the carrier 1 as a whole and also help to keep the energy absorbing dilatent compound material 6 in its predefined shape illustrated in FIG. 2.

Figure 3:
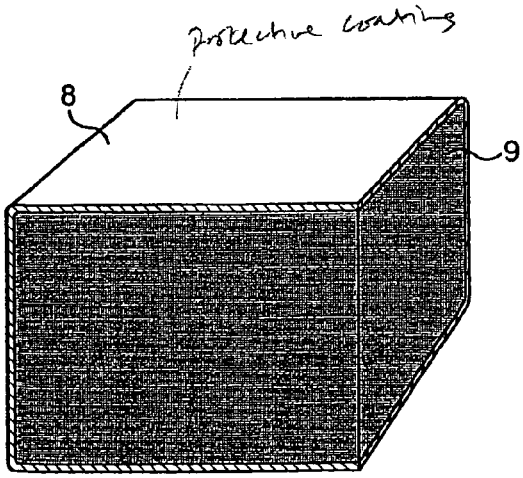
FIG. 3 is a perspective view, partly in cross section, showing an alternative form of energy absorbing material of the present invention.

FIG. 3 shows a corner portion of an alternative embodiment of flexible energy absorbing sheet material of the invention. Core 9 is made of, for instance, a cellulose, polyurethane or silicone foam material which is preferably of the open cell type. The cells can be large or small depending on the end application of the material. The foam core 9 is saturated in a solution of energy absorbing dilatent compound 6 in a method to be described hereafter, which is then allowed to dry out leaving the foam impregnated with the energy absorbing material 6 in the voids or cavities therein. The impregnated core 9 can then be dipped in a bath of protective material such as silicon rubber to form protective layer or coating 8 thereon.

Figure 4:
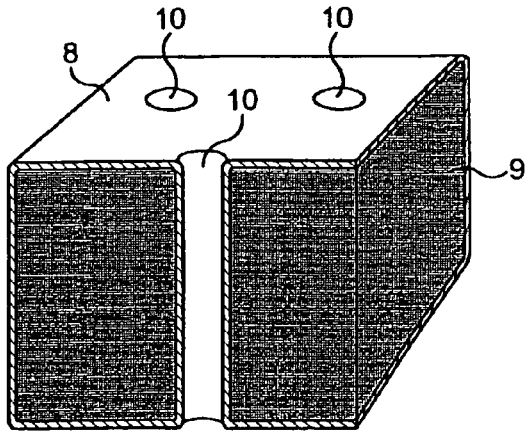
FIG. 4 is a view of the material shown in FIG. 3 but with holes formed through it.

FIG. 4 shows an alternative form of energy absorbing sheet to that shown in FIG. 3 (only a corner section thereof is illustrated). This foam sheet is identical to that shown in FIG. 3 except that it has through holes 10 formed in it. These holes 10 are formed in the foam before the energy absorbing dilatent compound material 6 is introduced into it and before the protective layer 8 is applied thereto. These holes 10 help to reduce the weight of the energy absorbing sheet material and also give the foam material more resilience for repeated energy absorbing purposes.

Figure 5:
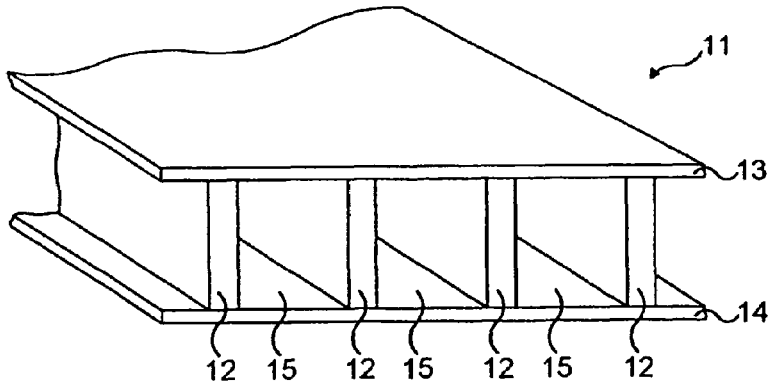
FIG. 5 is a perspective view of another type of carrier material.

FIG. 5 is a perspective view of another form of carrier which can be used to make the energy absorbing sheet material of the present invention. The carrier 11 comprises resilient partitions 12 which are sandwiched between and joined to top sheet 13 and bottom sheet 14. The sheets 12 and 13 may be made out of any suitable material (textiles are preferred) the outer surfaces of which may have a surface treatment or coating thereon, e.g. a waterproof coating. The resilient partitions 12 space the top sheet 13 from the bottom sheet 14 and voids or gaps 15 are formed therebetween. The partitions 12 are illustrated in FIG. 5 as being solid but they could have holes formed in them. The partitions 12 can be made of any suitable material but their prime function is to control the distance between the spaced upper and lower sheets 13 and 14. They are attached to the top and bottom sheets either vertically as illustrated or at an angle thereto. The partitions are preferably the same size but they can be of different lengths so that the distance between the spaced sheets 13 and 14 varies.

Figure 6:
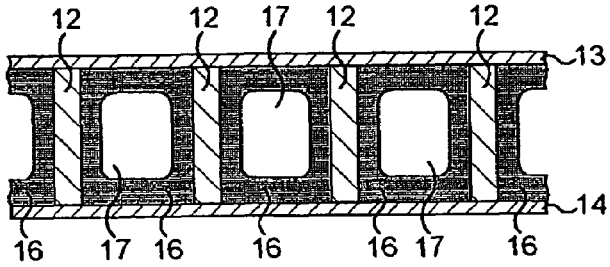
FIG. 6 is a cross section of the carrier material shown in FIG. 5 but after a dilatent compound has been added thereto to form an energy absorbing sheet of the invention.

FIG. 6 shows the carrier illustrated in FIG. 5 but with the gaps 15 filled with an energy absorbing dilatent compound material 16 to leave hollow cores 17 therein. These can be filled with a lightweight material such as DUOLITE™ spheres or another low weight filler which helps to add resilience to the carrier material and also helps to maintain the energy absorbing dilatent compound material 16 in the illustrated defined shapes. The liquid energy absorbing material 16 can be allowed to skin over so the hollow cores 17 are left with just a protective skin thereof.

The spaced sheets 3, 4 or 13, 14 can be made from any flexible material such as thin silicon sheet or a woven textile material. The spaced sheets do not have to be made of the same material. For example, the top sheet could be made from a close weave textile material containing a polyaromatic amide thread such as Kevlar for abrasion resistance. The top sheet could also be coated with a weatherproof membrane or polyurethane which encapsulates the energy absorbing dilatent compound material 6. The lower sheet can also be a textile material which can be a different material to the top sheet. By way of example, the lower sheet could be a wicking microfibre with a brushed surface so that it is comfortable for the wearer.

Although the invention has been described in relation to A material, it could be manufactured in the shape of a tube either by joining together the two facing edges of a rectangular sheet or by using a circular weaving technique for instance as used in manufacturing socks or stockings. The tube could be tapered if, for instance, it is to be worn as a leg protector.

The flexible energy absorbing sheet of the present invention can vary in thickness thereby allowing the thinner part to be placed in the area where the least impact protection is required whereas the thicker part would be located where the most impact protection is needed. In the case of a leg protector, the thinner area would be over the back of the leg and the thicker area would be at the front over the knee, thigh or shin. The protector can also have multiple layers.

Figure 7:
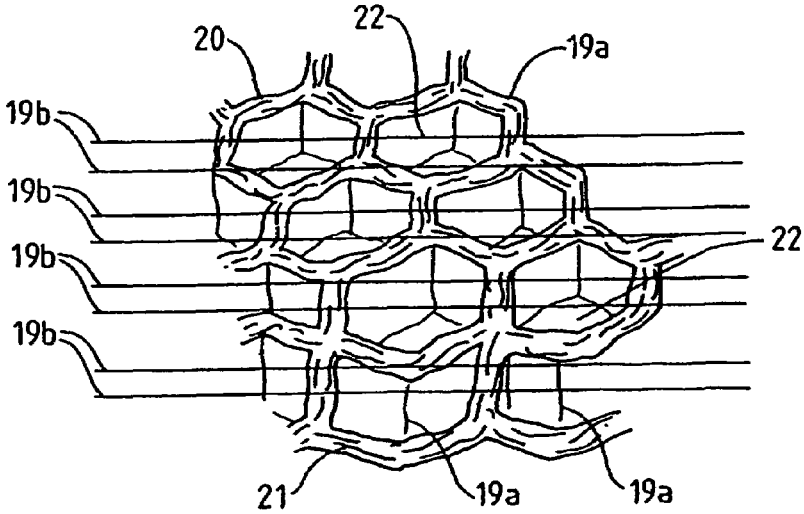
FIG. 7 is a perspective view of yet another type of carrier material with hexagonal holes in it which forms part of an energy absorbing sheet of the invention.

Referring now to FIG. 7, there is shown another form of carrier known as a "hex-type" spacer material which comprises a woven layer 19 sandwiched between an upper layer 20 and lower layer 21, both of which have hexagonal apertures 22 formed therein. The sides of each hexagonal aperture 22 in the upper sheet 20 are connected to the sides of the hexagonal aperture located directly below it in the lower sheet 21 by means of a plurality of threads 19*a* to give the central layer a cellular configuration. Individual threads 19*b* also extend through each cell as illustrated. This spacer material is available from Scott and Fyfe under No. 90.042.002.00.

Figure 8:
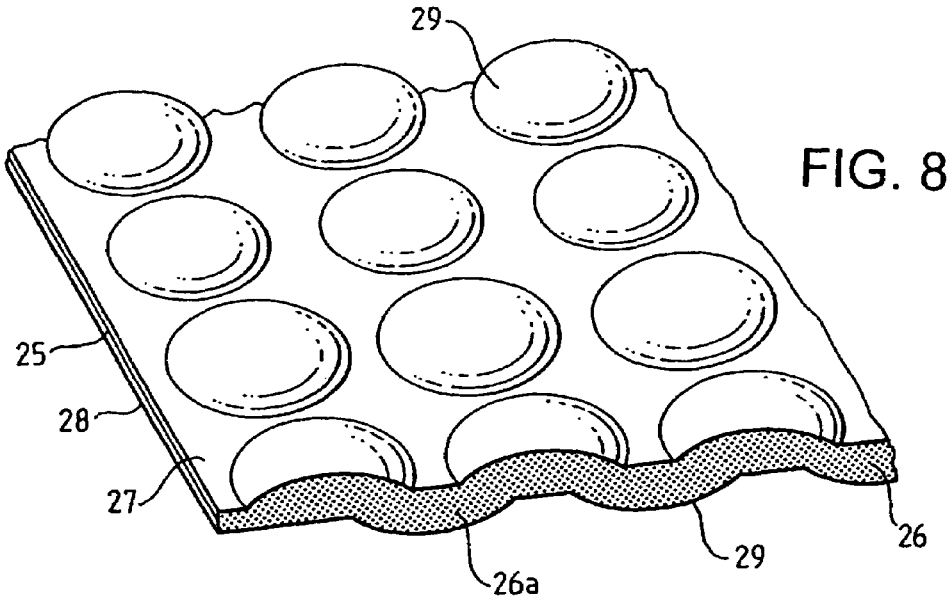
FIG. 8 is a cross section through another type carrier with bubbles formed in it.

An alternative carrier 25 is shown in FIG. 8 and it can be seen that it comprises woven upper layer 27 and woven lower layer 28 between which is sandwiched a spacer layer 26 comprising a plurality of threads 26*a*. Hemispherical bubbles 29 are formed in the upper surface 27 and the lower surface 28 which can be axially aligned or offset relative to each other as illustrated.

Figure 9:
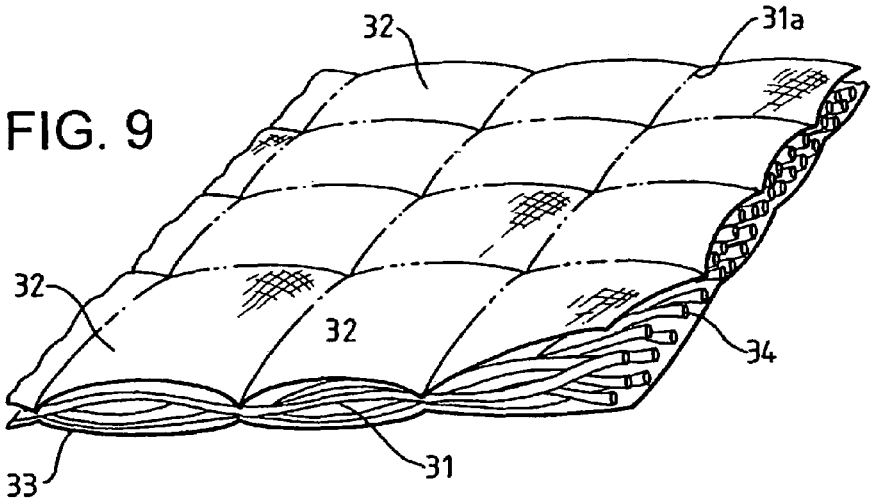
FIG. 9 is a cross section through yet another carrier in the form of a quilted carrier material.

FIG. 9 shows yet another form of carrier which comprises upper and lower textile layers 32 and 33 with a plurality of pockets 31 formed therein by stitching 31*a*. The pockets 31 are filled with threads or fibres 34 which can either be impregnated with dilatent compound, or extruded or otherwise formed (coated or filled) of dilatant material In order to form an energy absorbing sheet material of the present invention using the carriers shown in FIGS. 7 and 8, the voids therein between threads 19*a*, 19*b* or 26*a* would be impregnated and filled with dilatent compound in the manner already described in relation to the embodiments shown in FIGS. 1 to 6. As a result, the hexagonal material in FIG. 7 including the vertical threads 19*a* and horizontal threads 19*b* would be coated with the dilatent compound, spaces being left in the material in each of the hexagonal holes. In the case of the carrier shown in FIG. 8, the bubbles 29 and the threads 26*a* therebetween would be filled with the dilatent compound, said carrier and the soft dilatent compound being compressible on impact whereby the soft dilatent material becomes rigid to absorb the energy of the impact, the resilient carrier assisting the dilatent compound to return to its original configuration after the impact.

It will be appreciated from the foregoing that each of the flexible energy absorbing sheet materials described and illustrated comprises a carrier with voids therein which are impregnated or filled with energy absorbing dilatent compound material. The resilient carrier therefore supports the dilatent compound so there is no longer any need for it to be contained in a sealed enclosure as disclosed in my earlier patent.

The preferred energy absorbing material is a dilatent compound material which remains soft and flexible until it is subjected to the impact when its characteristics change rendering it temporarily rigid. The material then returns to its normal flexible state after the impact. The preferred energy absorbing material is a strain rate sensitive material such as a dilatent compound whose mechanical characteristics change upon impact. The preferred material is a dimethyl-siloxane-hydro-terminated polymer such as the DOW CORNING™ 3179 material or a lightweight version thereof incorporating DUOLITE™ spheres or a derivative thereof.

The carrier can be coated or impregnated with the dilatent compound in various ways. This can be done by heating the compound so that it flows more easily into the gaps or voids. Preferably, it is pressed into the voids but it can be pumped into them or sucked into them using a vacuum.

Alternatively the dilatent compound can be thinned down to reduce its viscosity to a point where it will flow easily. Any suitable thinning material can be used but a solvent is preferred which can be removed subsequently without adversely affecting the energy absorbing characteristics of the dilatent compound. Once the dilatent compound has been thinned it can be left while the solvent evaporates off. Examples of suitable solvents used either individually or in mixtures are propanol, methanol, dichloromomethane and trichloromethane.

Once the energy absorbing material or dilatent compound has been thinned down, it can be more easily transported into the gaps in the carrier. The carrier can be of the various types described above. For incorporation into a foam carrier, a low viscosity mixture of solvent and energy absorbing dilatant material needs to be used. To achieve this, the foam needs to be compressed and allowed to expand so that it draws the low viscosity dilatent compound into the foam and it is thoroughly worked into the cells therein. Once the gaps in the carrier are filled, partly filled or coated with the dilatent compound, the solution is left to dry out and the solvents are driven off using heat, vacuum or any other suitable method.

If a polyurethane foam is used as the carrier, the dilatant compound can be pushed, squeezed, pumped or otherwise worked into it. This is easier when the foam is of a large open cell construction, and heat is applied. This has been done with an open cell foam using a Dow Corning's dilatant material No. 3179 at 150° C. Cellulose foam has also been found to make a good carrier due to its high absorbent qualities.

Once the solvent has been removed, there is a potential reduction in volume of the dilatant energy absorbing material. If necessary therefore, the covering sheets of the carrier can be pre-stretched before the energy absorbing material is inserted into the cavities. Once the solvent has been driven off or the energy absorbing material has dried out, the covering sheets can be released thus accommodating the change in volume of the energy absorbing material due to the evaporation of the solvent.

The viscosity of the dilatant/solvent mixture can be reduced to the correct amount so that the required covering/penetration occurs in the carrier material. Using solvents can be expensive so other methods for impregnating the carrier could be used such as heating the dilatant to reduce its viscosity.

An alternative method is to make the dilatant in an emulsion form. The constituent parts of the dilatant compound are first be made into emulsions. Then these parts are then mixed/reacted to form an emulsion of the dilatant material. The ratio of water would be selected to ensure the correct viscosity of emulsion to coat/impregnate the carrier. Any other standard techniques for creating the emulsion could also be used. The emulsion can include all of the other additives that are used for the lightweight version. Solvents can be used to help stabilise the emulsion.

The advantages of an emulsion are that the dilatant material can be more easily handled and the impregnation can be carried out at the energy absorbing sheet manufacturer's factory as less special equipment is needed. The manufacturer simply adds the emulsion to a carrier material and drives off the water by any suitable method thereby leaving impregnated sheet material of the invention.

By way of example only, a standard mountaineering fleece jacket can be easily modified to include protective areas using an emulsion. The areas of the jacket that require protection can be masked off by any suitable method and the emulsion applied. Once dry, the product will have protection where the dilatant material has been left in the carrier. The emulsion can also be used to post impregnate parts that are made in an existing process.

Many automobile dash-boards or automobile bumpers are backed with foam. This foam can therefore be used as a carrier material and the emulsion can be applied to the foam. It can be pumped in or introduced in any other suitable way. Thus, the invention can be applied to many existing parts, without the need for a full redesign.

A different type of energy absorbing sheet material is illustrated in FIGS. 10-13 in which discrete modules of energy absorbing material are sandwiched between upper and lower sheets.

Figure 10:
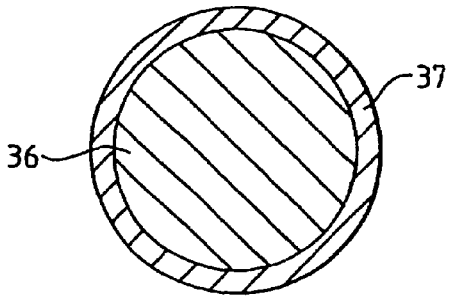
FIG. 10 is a cross section through an energy absorbing module for use in an energy absorbing material of the present invention.

FIG. 10 is a cross section through an extruded fibre of energy absorbing dilatent compound material 36. The extrusion is illustrated as being circular but any other shape can readily be produced such as oval, square, star shaped or triangular. The energy absorbing material 36 is enclosed in a covering layer 37 which may be a skin formed of the same material as the core 36 or it could be a different material. The extruded length of material would then be cross cut to form individual modules or segments.

The energy absorbing material can be extruded as a hollow tube which is then cut to the required length.

The modules can however be spherical and formed by allowing the energy absorbing material to drip out of a container to form the spheres. These could be allowed to skin over when exposed to the appropriate conditions in the same way that an open container of paint would skin over when left in contact with air. Each module would therefore consist of the energy absorbing material encapsulated in a thin skin of the same material.

A further way of producing modules is to encapsulate the energy absorbing material within a suitable encapsulant which could be sprayed onto the modules. This can be done while the modules fall out of the machine which forms their original shape or as the extrudate leaves the extruder. As an alternative to spraying, the modules could be coated in encapsulant by totally immersing them in a bath of encapsulant. Alternatively, the modules can be coated using a powder coating which is then very quickly heated to form the encapsulating layer in a way similar to powder coating techniques or any other suitable technique.

Figure 11:
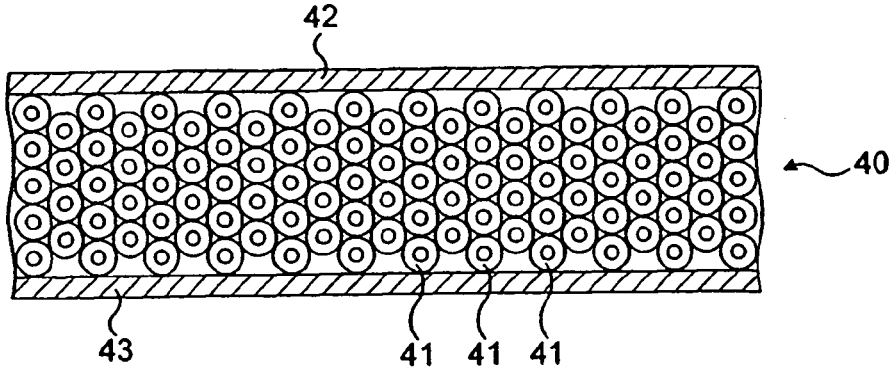
FIG. 11 is a cross section through one form of energy absorbing material in accordance with the present invention which uses a plurality of the modules shown in FIG. 10 which are randomly arranged.
Figure 12:
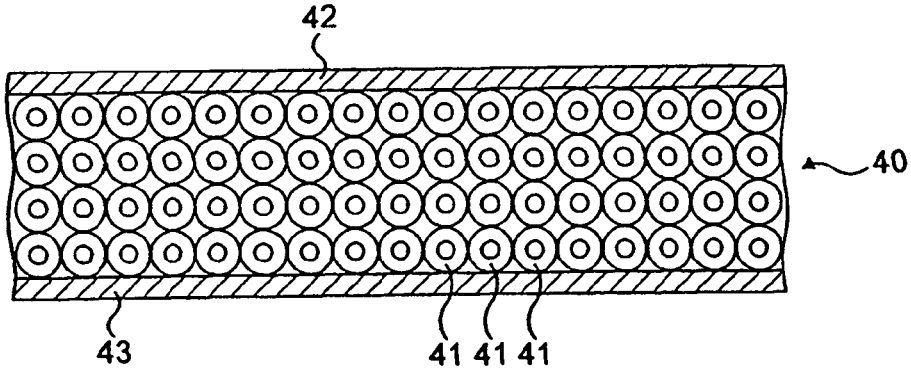
FIG. 12 is a view of an alternative form of energy absorbing material similar to that shown in FIG. 11 but in which the modules are axially aligned.
Figure 13:
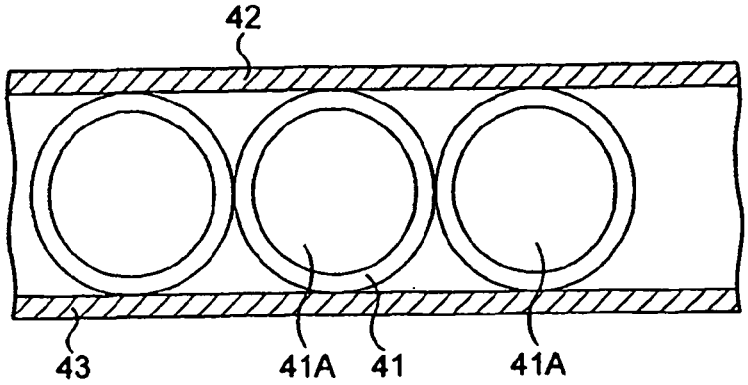
FIG. 13 is a cross section through an alternative form of energy absorbing material in accordance with the invention using a different form of module.

Having formed the modules, they can be arranged into an energy absorbing sheet for instance as shown in FIGS. 11-13.

Referring first to FIG. 11, there is shown a sheet 40 comprising a plurality of dilatent compound spheres 41 sandwiched between an upper sheet 42 and a lower sheet 43. The spheres 41 are randomly arranged.

The energy absorbing sheet 40A shown in FIG. 12 is virtually identical in construction to that shown in FIG. 11 except that the dilatent compound spheres 41 are arranged in linear columns between the upper sheet 42 and the lower sheet 43.

In the embodiment shown in FIG. 13, the energy absorbing sheet 40B is formed using a plurality of much larger hollow modules 41 of dilatent compound (preferably extruded) arranged between the upper sheet 42 and the lower sheet 43. The interior of the modules 41 can be filled with a gas at atmospheric or a higher pressure to give them increased resilience. Alternatively, the modules could be lightweight hollow balls coated with dilatent compound and a suitable skin if needed. The hollow in the centre of the ball would provide the resilience to allow the outer skin of dilatent material to spring back to its original shape after an impact. The hollow spheres can be filled with a lightweight material to assist their recovery to their original configuration after absorbing an impact. Alternatively, these hollow spheres can be placed in the sheet as shown in FIG. 3 or in the centre of a "thermotex" type of sheet as shown in FIG. 9.

The energy absorbing sheets containing modules of dilatent compound material illustrated in FIGS. 10-13 remain soft and flexible until subjected to an impact when their characteristics change rendering them temporarily rigid, each module returning to its normal flexible state after the impact.

The energy absorbing dilatent compound material within the modules absorbs the impact force and spreads the load thereof during the impact. The preferred material is a dimethyl-siloxane-hydro-terminated polymer such as the material sold by Dow Corning™ Corporation, Midland, Mich., under the catalogue number 3179 or a lightweight version thereof containing DUOLITE™ spheres.

Figure 14:
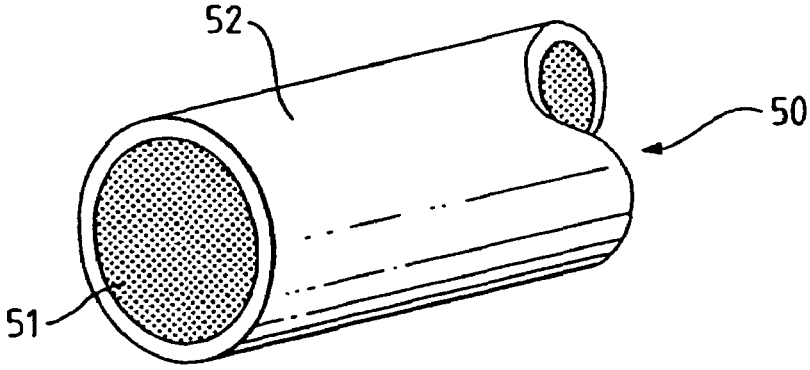
FIG. 14 shows one form of energy absorbing extrusion which can be used to form an alternative type of energy absorbing material of the invention.
Figure 15:
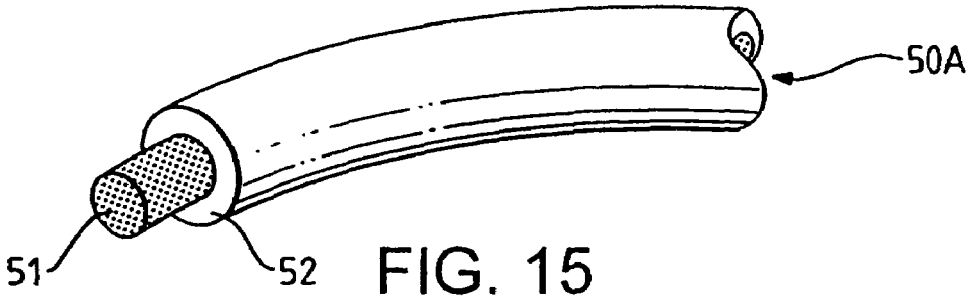
FIG. 15 is a perspective view of an alternative form of extrusion.
Figure 16:
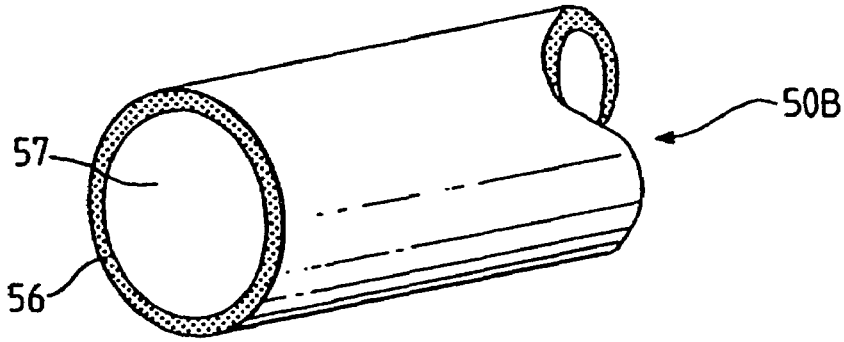
FIG. 16 is a view of a still further form of extrusion.

Referring now to FIGS. 14-16, there is shown a thread which can be used to form an energy absorbing sheet material of the invention. Referring first to FIG. 14, there is shown an extrusion 50 which comprises a tubular core 51 made of energy absorbing material. This would be extruded as a continuous length. The core 51 is enclosed in its own skin 52.

An alternative form of thread 50A is shown in FIG. 15 which is virtually the same as that shown in FIG. 14 except that the skin 52 is much thicker. The covering 52 could be a different material from the core 51.

FIG. 16 shows a still further alternative thread 50B which comprises an extruded tubular member 56 made of an energy absorbing material having a hollow central core 57.

Any suitable method of creating the thread or fibre can be used. These include extrusion, co-extrusion, extrusion and coating, or pultrusion. As an alternative to the thread shown in FIG. 16, the tubular member 50B can made out of any energy absorbing material, around a central core of another material. This other material can be a thread or fibre formed using any suitable process. By way of example only, the central fibre can be pulled through a bath of energy absorbing material which is then allowed to form the coating 50B. This can be a pultrusion technique. The central core will give added tensional strength to help prevent the finished thread from stretching too much or breaking.

Figure 17:
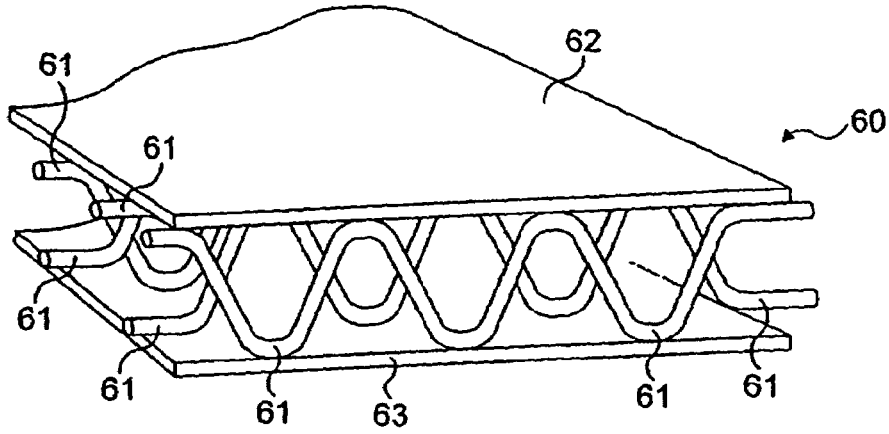
FIG. 17 shows the way in which the extrusions shown in FIGS. 14-16 can be incorporated into an energy absorbing material of the present invention.
Figure 18:
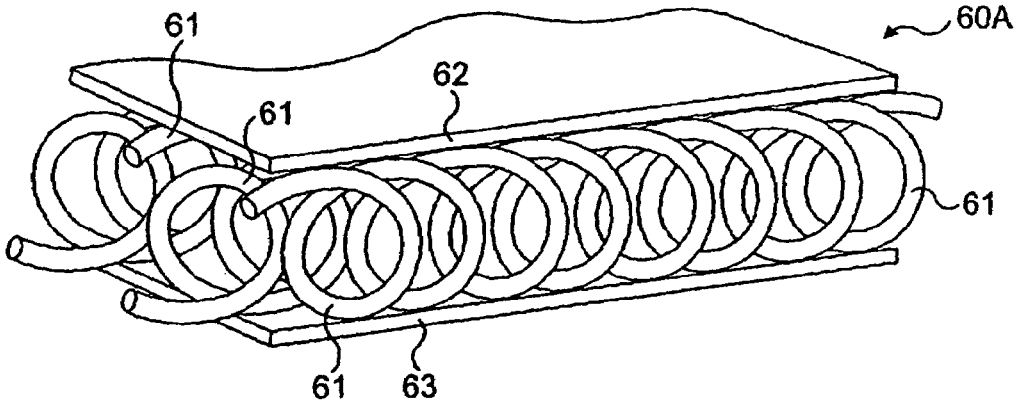
FIG. 18 shows an alternative form of energy absorbing material in accordance with the present invention.

FIGS. 17 and 18 show two alternative ways in which the energy absorbing threads shown in FIGS. 14-16 may be used to form an energy absorbing sheet of the present invention. Referring first to FIG. 17, it can be seen that numerous threads 61 such as that shown in FIGS. 14-16 are sandwiched between an upper sheet 62 and a lower sheet 63. The threads are formed into a zig-zag shape as shown but only in the weft direction. In another embodiment, they can be arranged in both the warp and weft directions. The sheets 62 and 63 are preferably made of a textile material and are attached to the threads 61 of energy absorbing material.

FIG. 18 shows an alternative form of energy absorbing sheet made using energy absorbing threads such as those shown in FIGS. 14-16 which are formed into coils sandwiched between upper sheet 62 and lower sheet 63. The coils 61 are shown only in the weft direction but in another embodiment, they can be in both the warp and weft direction. The sheets 62 and 63 are preferably made of a textile material which are attached to the coils 61.

The energy absorbing material within the threads 61 absorbs the impact force and spreads the load thereof during the impact. Preferably the energy absorbing material within the co-extrusions is a strain rate sensitive material such as a dilatent compound whose mechanical characteristics change upon impact. The preferred material would be a lightweight version of the strain rate sensitive material including DUOLITE™ spheres. The preferred material is dimethyl-siloxane-hydro-terminate polymer such as the material sold by Dow Corning™ Corporation, Midland, Mich., under No. 3179 or a lightweight version thereof.

Preferably the extrusions or co-extrusions 61 of the material are not encapsulated but are contained by their own skin which would be formed by exposing the raw modified dilatent to the correct conditions. For example, exposing the material to air or dipping it in another material or exposing it to ultra-violet light thus causing a skin to be formed. The family of silicon compounds known to form a skin but still remain flexible at the core. One example of this would be standard silicon sealant.

Figure 19:
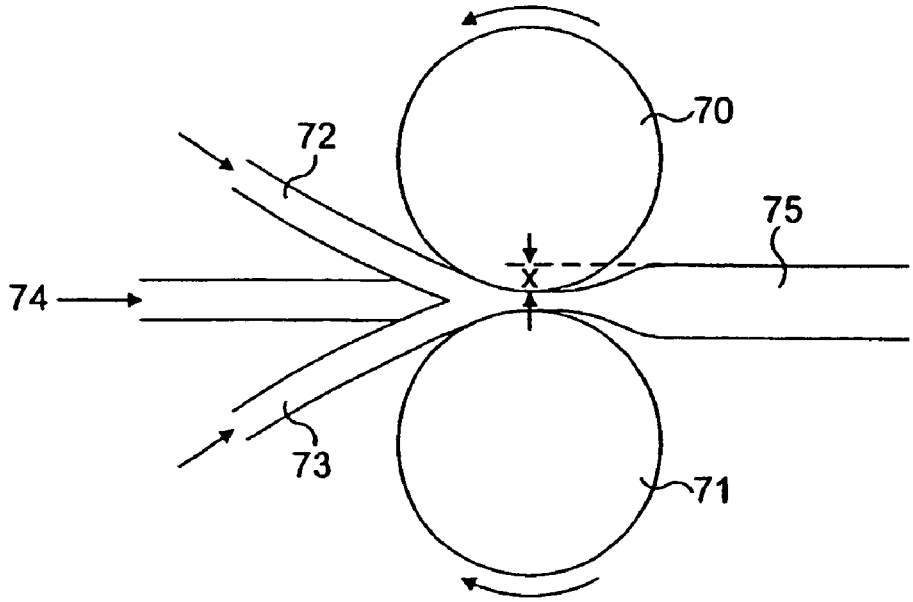
FIG. 19 shows a first method of manufacturing a first form of energy absorbing material of the invention.

FIG. 19 shows one method of manufacturing an energy absorbing sheet material of the invention using a machine or roll mill having a pair of spaced (usually heated) rollers 70 and 71. Two layers of carrier material 72 and 73 such as those shown in FIGS. 1-9 are fed between the rollers 70 and 71 while a layer of dilatant compound 74 is also fed between the rollers 70 and 71 and between the layers 72 and 73. The rollers press the dilatant compound 74 into the carrier layers 72 and 73. "X" indicates the degree of pinch that the two layers 72 and 73 are compressed together. It will be noted that the formed sheet 75 impregnated with the dilatant compound 74 which emerges from the rollers 70 and 71 returns to its normal thickness.

Another set of rollers (not shown) can be provided downstream of the first set to apply further pressure to the sheet 75 to help force the dilatant material 74 into it if required. The dilated material helps to hold the two sheets 72 and 73 together.

Figure 20:
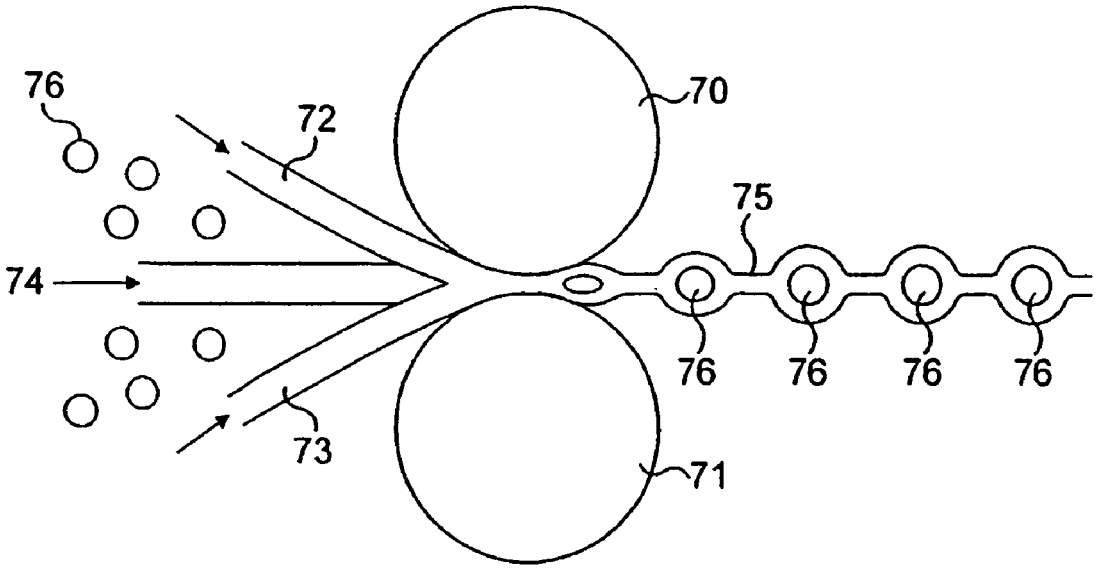
FIG. 20 shows a method of manufacturing an alternative form of energy absorbing material in accordance with the present invention.

FIG. 20 shows a method of manufacturing an energy absorbing sheet 75 of the present invention in which spheres 76 are additionally introduced into the layer of dilatant compound 74 fed between the rollers 70 and 71. These spheres 76 provide additional resilience to the finished sheet material 75 which emerges from the downstream side of the rollers 70 and 71. Otherwise, the method of manufacture is the same as that described with reference to FIG. 19.

Figure 21:
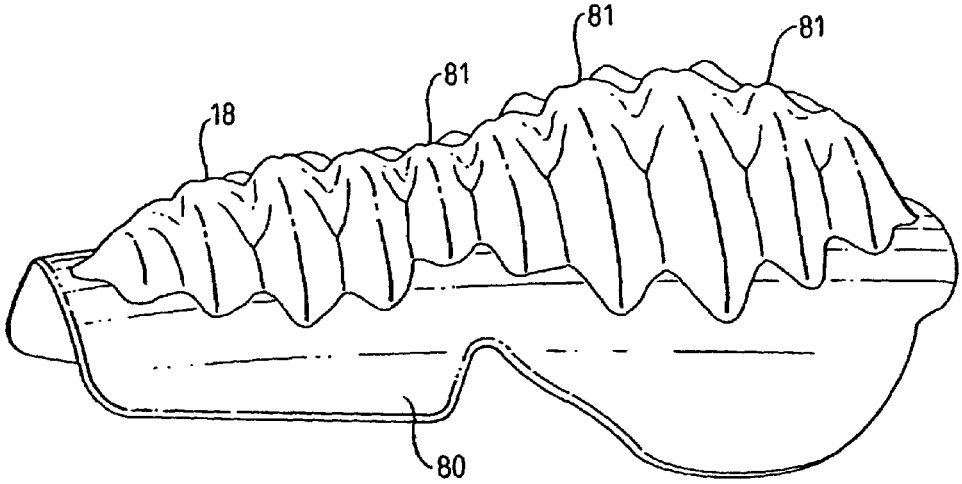
FIG. 21 is a perspective view of a body protector moulded from a sheet of energy absorbing material of the invention.
Figure 22:
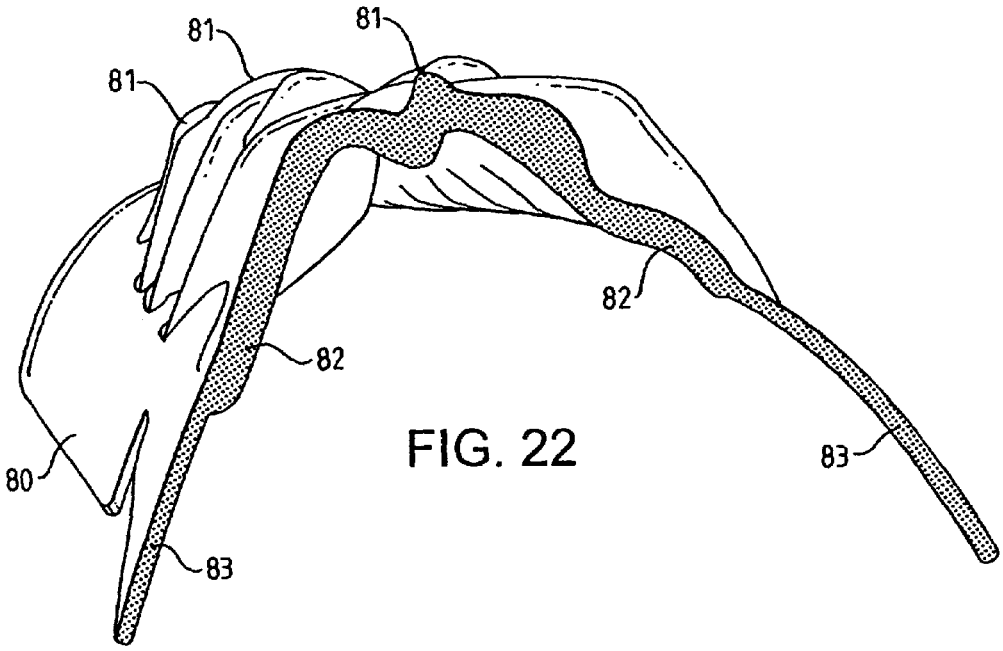
FIG. 22 is a cross section through the body protector shown in FIG. 21.

Referring now to FIGS. 21 and 22 of the drawings, there is shown an elbow pad 80 which has been heat formed from a spacer material filled with dilatant material. The moulded pad 80 has a plurality of apexes 81 along its length which help to increase comfort and flexibility. The apexes 81 also help to absorb and distribute the impact energy.

The pad 80 can however be moulded from a foam material such as that shown in FIGS. 3 and 4.

The thickness of the pad can vary to provide more protection where it is needed. For instance, it can be seen from FIG. 22 that upper region 82 is thicker that lower region 83 which helps spread the load away from the bones of the wearer which are nearer the surface.

To manufacture the pad shown in FIGS. 21 and 22, a sheet of spacer material, for instance as shown in FIG. 1 or 5 is inserted into a mould in its raw state. The material is then heat set (usually at about 150° C.). After about 5 minutes it is removed from the mould and allowed to cool. The "heat set" material keeps its moulded shape and has the required level of resilience. Subsequently dilatant material is integrated or impregnated into the moulded shape in the manner already described.

An alternative method of manufacturing a moulded part such as that shown in FIG. 21 is to place the carrier fabric and dilatant compound in a heated mould which is then pressed closed. After a few minutes, the dilatant compound will flow to the appropriate area of the mould, and also the carrier material will become "heat set". After the moulded part is removed from the mould and allowed to cool, it can be finished ready for any post trimming, or coating that may be subsequently needed. This process is particularly suitable for producing more complicated mouldings. It should be noticed that the 3D shape and thickness can be varied according to its end application. The cost of a single heat press process offers significant cost savings over other examples of protector that require one or more injection moulded parts and subsequent assembly thereof.

Using the same heat press manufacturing method, if less dilatant material is placed in the mould then, it will not impregnate the whole of the part to be moulded. In this way, it is possible to only impregnate the "thicker" central apexes 82. The non-impregnated parts of the carrier material can then be used to attach the moulded protector to a garment. Using a further derivate of this technique, it would be possible to vary the quality of dilatant compound in the moulded protector, for example, a much lighter dilatant compound can be used for most of the protector than that used for the important central section, or the position directly over the elbow joint. In this manner, the same mould can be modified to suit different applications. A further manufacturing method would be to inject the dilatant material.

The methods described above can also be used with multi-layer carrier materials or with a backing foam or a hex-type spacer material such as that shown in FIG. 7.

Test Results:

When subjected to European Motorcycle CE Standard Test No. EN1621, samples of the above heat-set products shown in FIGS. 21 and 22 achieved results of 16.2 Kn. By comparison, fully encapsulated injection moulded parts of the same shape have achieved 10 Kn.

Figure 23:
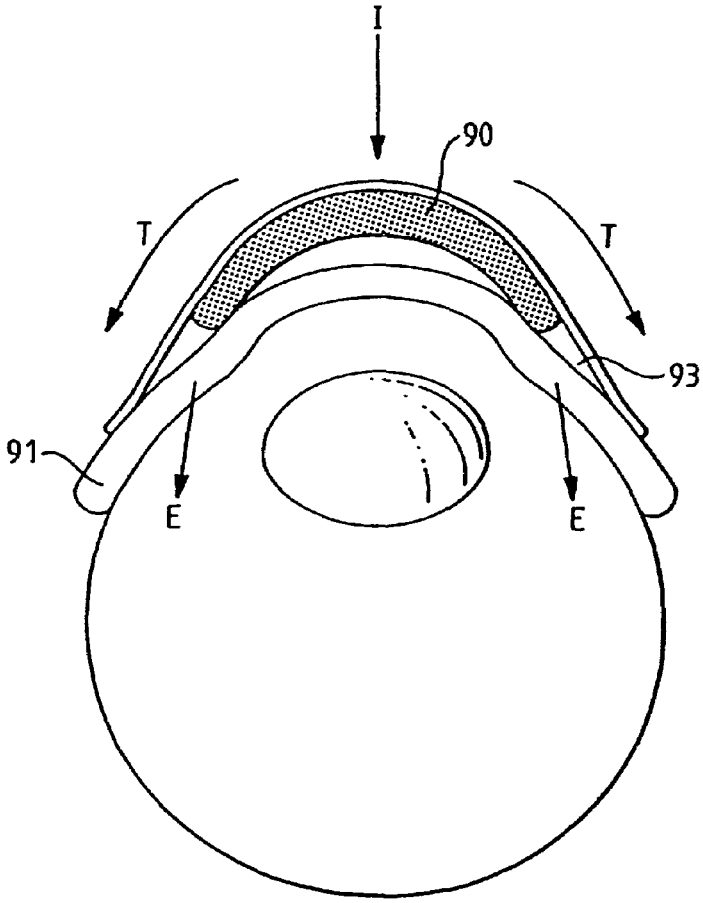
FIG. 23 is a schematic cross section showing a protective insert made from a material of the present invention which can be used in existing body armour.

FIG. 23 is a cross section through a piece of known body armour, comprising a hard outer shell 90 with a foam backing 91. An insert 92 made of an energy absorbing material of the invention is inserted in pocket 93 between shell 90 and foam backing 91. The sheet material of the present invention can therefore be used to help increase the performance of existing protectors thus avoiding the need for a complete redesign. The insert can be cut into any required shape to ease the fitting process into the existing protectors. The insert can be readily incorporated into existing products during assembly. Significant impact performance improvements have been measured with these simple inserts.

Test Results:

Using European Motorcycle CE Standard Test No. EN1621, tests were carried out by SATRA in Kettering, UK using 50 joules of energy, a 5 kg mass and a 50 mm radius mandrel (35 Kn is the CE pass level)

| | |
|---|---|
| 1) Dainese Elbow Protector | 22.5 Kn |
| 2) Dainese Elbow Protector with insert A | 16 Kn |
| 3) K2 Elbow Protector | 23.4 Kn |
| 4) K2 Elbow Protector with insert A | 17.2 Kn |

Insert A was a 70 mm×70 mm×4.5 mm thick spacer material made by Scott & Fyfe No. 90.042.002.02. impregnated with Dow Corning™ Dilatant No. 3233 with a lightweight filler therein of DUOLITE™ spheres. Insert A was placed behind the hard outer shell of the elbow protector.

The above results show an improvement of approximately 30% using the material of the invention as a simple insert, the insert adding only 30 g to the weight of the protector.

Figure 24:
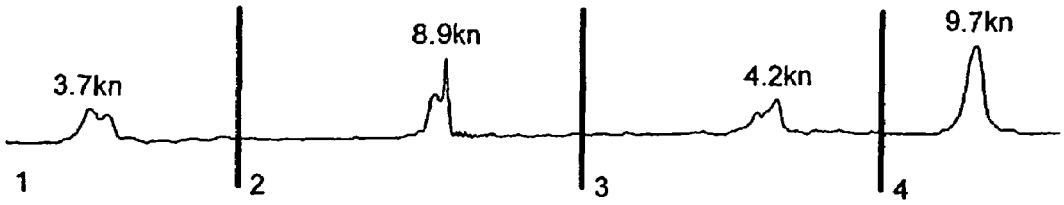
FIG. 24 shows the results of energy absorbing tests carried out on material of the invention.

FIG. 24 shows the results of tests obtained from foam samples 1-3 made from a material of the present invention when subject to standard Test Procedure EN1621 as detailed above.

Graph 4 is the control test which was carried out on a moulded elbow pad which includes an encapsulated dilatant compound in accordance with my earlier patent application. It can be seen that the result achieved is just below 10 Kn which is an excellent result. (A typical motorcycle product such as a Dainese elbow pad would achieve a best result of 22.5 Kn and an average result of about 28-30 Kn.) The best result was obtained by applying the impact force directly above the elbow joint where the pad offers the maximum protection.

Graph 1 shows the results obtained using an open cell cellulose foam (large cell size 0.5 mm-3 mm) impregnated with a lightweight dilatant compound made by Dow Corning™ under No. 15455-030 which is a light weight version of their compound No. 3179 and includes DUOLITE™ spheres.

It should be noted that foam not impregnated with dilatant compound would achieve a very high result, probably over 100 Kn. It should also be noted that Graph 1 has two peaks which is beneficial and that the construction of the sheet material of the invention can be varied to obtain them.

Graph 2 shows the result for a different cellulose foam impregnated with the same lightweight dilatant compound. This had a smaller cell size of 1-1.5 mm and the peak force measure was 8.9 Kn. It should be noted that the graph still has the characterising double peak shape and that the second peak is much taller than the first peak. This is because the sample has started to break-up and bottom out. A stronger foam carrier material (i.e. Polyurethane foam) with a protective coating should remove this taller second peak.

Graph 3 shows the result obtained using a foam carrier with a small cell size, impregnated with a light weight derivative of Dow Corning™ 3179 dilatant compound incorporating DUOLITE™ spheres. The cell size for this foam is less than 1 mm and it can be seen that a peak force of 4.2 Kn was achieved. This graph again has the characteristic double peak although the second peak is only slightly higher than the first due to a different combination of dilatant compound and the small cell size.

In this way, it is possible to modify the energy absorbing material of the invention for different applications by using different carrier materials and different dilatant compounds depending on the application. It is also possible to layer the material so that each layer can deal with a different speed/force energy regime.

Figure 25:
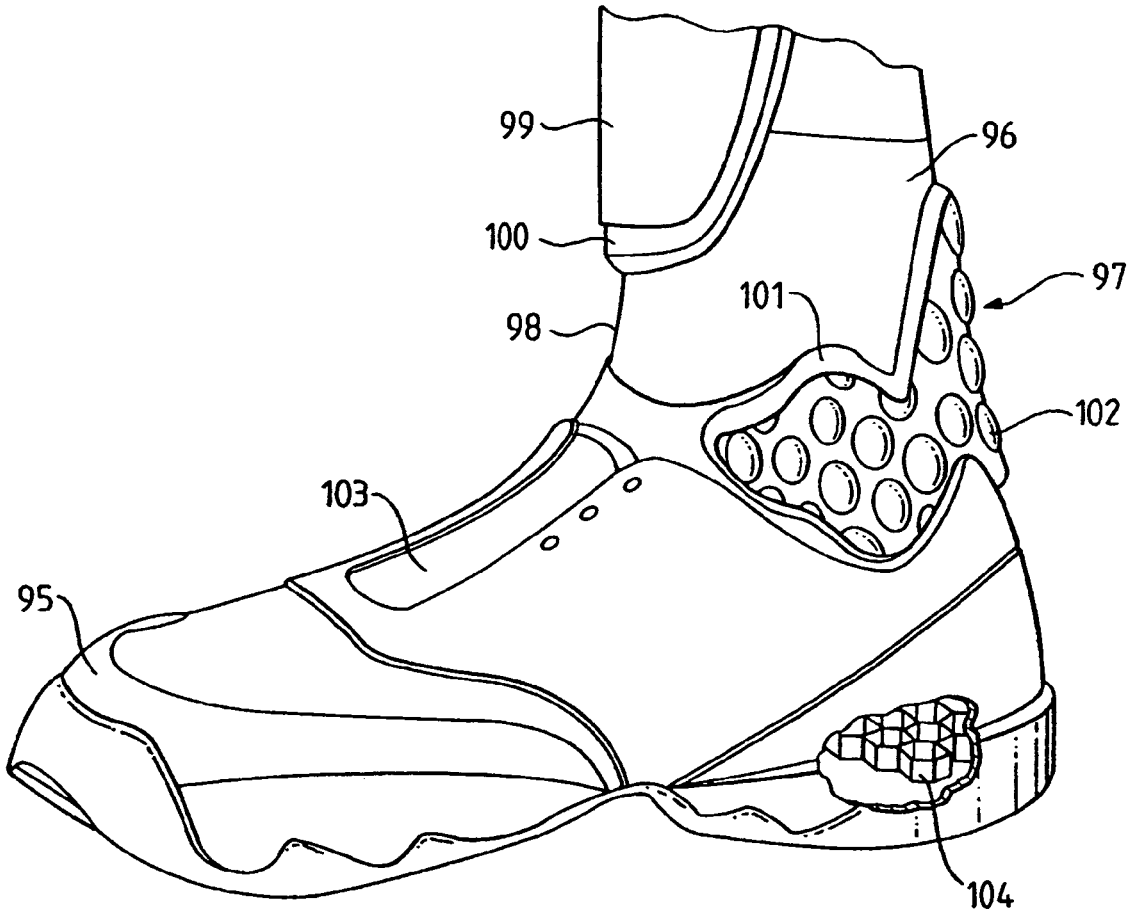
FIG. 25 shows various uses of energy absorbing sheet materials of the invention in a footballing context.

FIG. 25 shows various ways that an energy absorbing sheet material can be used in a sporting context. The illustration shows a footballer's boot 95, ankle 96, heel 97 and shin region 98.

As illustrated, the shin 97 is covered with a protective shin pad 98 which comprises a rigid outer shell 99 with an energy absorbing sheet backing 100 of the invention.

The heel region 97 and lower part of the ankle 96 are protected by an energy absorbing protector 101 made from an energy absorbing material of the invention such as that shown in FIG. 8. The illustrated protector 101 has a plurality of bubbles 102 formed on the surface thereof filled and/or concerned with a dilatant material which absorbs the energy of a kick in the heel or ankle region.

Another protector 103 made of an energy absorbing material of the invention is located in the boot 95 over the top of the wearer's foot to protect the metatarsal bones therein from damage as a result of a kick or other pressure being applied in that region.

The illustrated boot 95 also includes a shock absorber 104 which can be made, for example, of the hexagonal material of the invention shown in FIG. 7 inserted in the base of the heel of the boot.

All of the examples of sheet materials of the present invention described above differ from my original patent as the energy absorbing material is not contained in an encapsulating envelope.

It is possible to cover the resilient carrier with a protective coating such as Dow Corning® 84, Z 6070 and Syloff® 23A Catalyst and 3481 Base and 81 T Catalyst. Coatings like these can be applied in any suitable manner. It is also possible to use coatings that actually react with the surface of the dilatant material. These not only provide a protective layer, but they cross link with the surface of the dilatant material further protecting the surface thereof. However, any alternative method to protect the surface or form a protective skin thereon can be used. By way of example only, this could be achieved by modifying the material so that it forms extra cross links or a protective skin when subjected to the correct conditions. The protective coating can however be similar, for example to that of Raychem 44 spec wire, which are Radiation cross linked fluoro polymer bonded to a radiation cross linked polyolefin.

The protective coating helps to protect the material of the present invention from any potentially harmful chemicals such as those found in dry cleaning, etc.

The preferred energy absorbing material is a strain rate sensitive material and includes a dilatant compound whose mechanical characteristics change in the aforementioned manner upon impact. In addition to such a dilatant compound, the energy absorbing material can also include a lubricant (for example a plasticizer or diluent), filler (for example a thickener), or the like. The preferred dilatants include boron containing organo-silicone polymers, or polyborosiloxanes. Alternative polymers with dilatant characteristics include xanthan gum, guar gum, polyvinyl alcohol/sodium tetraborate, as well as other hydrogen bonding polymer compositions. Examples of suitable dilatant materials are disclosed in WO00/46303, the disclosure of which is incorporated herein by reference.

The preferred polyborosiloxanes are borosiloxane copolymers and can be prepared by the condensation of boric acid, or a boric acid ester, with a silanol terminated poly di-(alkyl and/or aryl)-siloxane.

The siloxane groups in the preferred borosiloxane copolymers are of the formula —$(OSiR_1R_2)$—, wherein $R_1$ and $R_2$ can be the same or different and each, independently, can be a substituted or unsubstituted alkyl or aryl group. Preferred such alkyl groups contain 1 to 6 carbon atoms and, more preferably, 1, 2, 3, 4 or 5 carbon atoms. The preferred substituted alkyl groups are hydrofluoroalkyl groups. In preferred embodiments, one or both of $R_1$ and $R_2$ is a methyl, phenyl or 1,1,1, trifluoropropyl group. Preferred siloxane groups include the following:—

—(OSiMePh)-, —$(OSiMe_2)$-, —$(OSiPh_2)$- and —$(OSi(CH_2CH_2CF_3)Me)$-; wherein Me is a methyl group and Ph is a phenyl group.

The borosiloxane copolymers employed in the practice of the present invention can include more than one type of siloxane group, each with a different combination of substituents $R_1$ and $R_2$, and the siloxane groups, preferably, are in blocks or units of the formula —$(OSiR_1R_2)_n$—, wherein n is an integer greater than or equal to 4 and less than or equal to 50. Preferred such polysiloxane units include: —$(OSiMePh)_n$, $(OSiMe_2)_n$, $(OSiPh_2)_n$, $(OSi(CH_2CH_2CF_3)Me)_n$, $[(OSiMe_2)_a(OSiMePh)_b]_n$ and $[(OSiMe_2)_a(OSiPh_2)_b]_n$, wherein n is as defined above, a and b are integers greater than or equal to 1 and less than or equal to 49, and a+b=n. In $[(OSiMe_2)_a(OSiMePh)_b]_n$ and $[(OSiMe_2)_a(OSiPh_2)_b]_n$, the two types of siloxane group can alternate, or can be randomly located in the polymer chain.

The preferred borosiloxane copolymers for use in the present invention are those included in Dow Corning® 3179 Dilatant Compound and Dow Corning® Q2-3233 Bouncing Putty.

Examples of suitable lubricants include silicone oils, fatty acids, fatty acid salts and hydrocarbon greases. Suitable fillers include solid particulate and fibrous fillers, such as silica, silica and/or polymeric microspheres, phenolic resins, thermoplastic materials, ceramic materials, metals and pulp materials.

Examples of suitable dilatant materials for use in the practice of the present invention are Dow Corning® 3179 Dilatant Compound and Dow Corning® Q2-3233 Bouncing Putty.

The invention claimed is:

1. A flexible energy absorbing material comprising a resilient carrier with voids or cavities therein, said carrier being coated or impregnated or combined with a dilatant material, wherein the resilient carrier supports the dilatant material and the resilient carrier is a spacer fabric comprising a resilient core sandwiched between a pair of covering layers.

2. A material as claimed in claim 1 wherein the dilatant material is a dilatant compound.

3. A material as claimed in claim 1 wherein the resilient core comprises a layer of yarn and the covering layers have a plurality of apertures therein.

4. A material as claimed in claim 3 wherein the yarn is woven into a resilient pile.

5. A material as claimed in claim 3 wherein the yarn is knitted into a resilient pile.

6. A material as claimed in claim 1 wherein elongate hollow channels are formed in the resilient core.

7. An energy absorbing material as claimed in claim 2 wherein the dilatant compound is a dimethyl-siloxane-hydroterminated polymer.

8. An energy absorbing material as claimed in claim 2 wherein the dilatant compound has ion exchange resin spheres or lightweight filler therein.

* * * * *

UNITED STATES PATENT AND TRADEMARK OFFICE

CERTIFICATE OF CORRECTION

PATENT NO. : 7,608,314 B2
APPLICATION NO. : 10/797756
DATED : October 27, 2009
INVENTOR(S) : Daniel James Plant It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 152 days.

Signed and Sealed this

Twelfth Day of October, 2010

David J. Kappos

David J. Kappos
*Director of the United States Patent and Trademark Office*